US006639135B1

(12) United States Patent
Lucas

(10) Patent No.: US 6,639,135 B1
(45) Date of Patent: Oct. 28, 2003

(54) BODY COMPONENTS FOR HOLLOW BODY STRINGED INSTRUMENTS AND METHOD OF FABRICATING SAME

(76) Inventor: Randy Lucas, 13360 W. Becks Grove, Columbus, IN (US) 47201

( * ) Notice: Subject to any disclaimer, the term of this patent is extended or adjusted under 35 U.S.C. 154(b) by 0 days.

(21) Appl. No.: 10/193,546

(22) Filed: Jul. 11, 2002

(51) Int. Cl.[7] ..... G10D 3/00
(52) U.S. Cl. ..... 84/291
(58) Field of Search ..... 84/290, 291, 267, 84/293

(56) References Cited

U.S. PATENT DOCUMENTS

| | | | | |
|---|---|---|---|---|
| 222,287 | A | | 12/1879 | Kreutzer |
| 2,674,912 | A | | 4/1954 | Petek |
| 3,641,862 | A | | 2/1972 | Rendell |
| 3,969,558 | A | | 7/1976 | Sadashige |
| 4,012,548 | A | | 3/1977 | Roberti |
| 4,248,124 | A | | 2/1981 | Klaiber et al. |
| 4,337,682 | A | | 7/1982 | Schwichtenberg |
| 4,361,458 | A | | 11/1982 | Grajek et al. |
| 4,391,177 | A | | 7/1983 | Grajek et al. |
| 4,743,484 | A | | 5/1988 | Robbins |
| 4,931,124 | A | | 6/1990 | Baum |
| 5,040,582 | A | | 8/1991 | Hsu |
| 5,135,597 | A | | 8/1992 | Barker |
| 5,143,792 | A | | 9/1992 | Cramer et al. |
| 5,170,000 | A | | 12/1992 | Hayashida et al. |
| 5,277,953 | A | | 1/1994 | Tsuda |
| 5,418,034 | A | | 5/1995 | McGuire, III |
| 5,511,455 | A | | 4/1996 | Steinberger |
| 6,120,910 | A | * | 9/2000 | Szenics ..... 428/447 |
| 6,190,491 | B1 | | 2/2001 | Sifel et al. |

* cited by examiner

*Primary Examiner*—Kimberly Lockett
(74) *Attorney, Agent, or Firm*—Barnes & Thornburg

(57) ABSTRACT

A technique for fabricating body components for a hollow body stringed instrument includes providing a plurality of wood veneers all of a common wood species and each defining a grain pattern. A formable medium is provided between opposing faces of each veneer pair and the plurality of veneers are face bonded together with the grain patterns of each lying in a common orientation. In one embodiment, the plurality of wood veneers are veneer flitches, and the resulting composite veneer structure is formed as a stack of flitch-matched veneers. Alternatively, at least one of the outer veneers defines a high-quality or high-grade wood veneer and the remaining veneers in the resulting composite veneer structure define lower quality or lower-grade wood veneers. In either case, the flexible composite veneer structure is fitted to a mold and maintained therein until the formable medium cures to thereby provide a body component having a desired shape.

20 Claims, 4 Drawing Sheets

BODY COMPONENTS FOR HOLLOW BODY STRINGED INSTRUMENTS AND METHOD OF FABRICATING SAME

FIELD OF THE INVENTION

The present invention relates generally to hollow body stringed instrument fabrication techniques, and more specifically to techniques for fabricating stringed instrument body components.

BACKGROUND OF THE INVENTION

Hollow body stringed instruments, such as violins, cellos, upright basses, acoustic guitars, and the like, as well as pianos, organs and other keyboard instruments, have traditionally been fabricated from solid hardwoods, and wood species for the various instrument components have typically been carefully selected by luthiers to achieve a balance of strength, hardness, tone and other properties. In the steel string, flat top, acoustic guitar industry, for example, choices for guitar tops (or soundboards) typically focus on the tonal properties of the wood, and soundboards are commonly selected from a variety of known tone woods such as spruce, cedar, Koa, mahogany, and the like. Wood choices for other body components, such as the guitar backs and sides, typically take into consideration not only the tonal properties of the wood but its aesthetic appearance as well. Many hardwood varieties have accordingly been used to construct acoustic guitar backs and sides including, for example, mahogany, rosewood, ash, Koa, ebony, maple, and the like.

Regardless of the types and/or species of woods selected for hollow body stringed instrument construction, such wood must not only satisfy tonal objectives, but must also possess a combination of strength and hardness that is sufficient to withstand tension applied thereto by the plurality of strings and bracing arrangements while resisting deformation, cracking and deleterious effects associated with changes in, and extremes of, temperature and humidity. Wood for hollow body stringed instrument construction is typically prepared from quarter-sawn (e.g., vertical grain) hardwood lumber as illustrated in FIGS. 1–3. Referring to FIG. 1, an end view of a typical log 10 is shown with a characteristic concentric grain pattern 10*a*. Quarter-sawn sheets or boards 12 are cut from log 10 such that the grain pattern 10*a* runs generally parallel with the longitudinal axis 10*b* of board 12. Sheets 14 of thickness d1 are then sliced from board 12, as shown in FIG. 2, wherein d1 typically ranges between 0.08 and 0.125 inches. Book matched sheets 14*a* and 14*b* are then typically joined via an appropriate bonding medium to form the instrument top or back 16 as illustrated in FIG. 3. Although not specifically illustrated in the drawings, the instrument sides are likewise typically book matched and joined via an appropriate bonding medium during construction of the instrument body.

Over the years, luthiers have made various attempts to depart from the traditional solid wood hollow body stringed instrument construction shown and described hereinabove for various reasons. Referring to FIG. 4, for example, one such alternative construction is illustrated wherein a hollow body stringed instrument body component 15 (e.g., top, back or side) is shown in cross section as comprising a lamination of two veneers 14*c* and 14*d*, each typically having thickness d2, wherein veneers 14*c* and 14*d* are bonded together using a suitable bonding medium with the grain patterns of veneers 14*c* and 14*d* arranged transverse to each other for increased strength and resistance to cracking. Another example of an alternative construction of a hollow body stringed instrument body component 15' is illustrated in FIG. 5 as comprising a wood core member 18, having thickness d3, sandwiched between two veneers 14*e* and 14*f*, each typically having thickness d4. Veneers 14*e* and 14*f* are typically formed of wood types and species traditionally used in the construction of hollow body stringed instrument body components as described hereinabove, while core member 18 is typically formed of a different wood type or species that may not have stiffness and/or density characteristics similar to that of veneers 14*e* and 14*f*. Hollow body stringed instrument construction of the type illustrated in FIG. 5 is commonly used to produce cheaper instruments in terms of material cost yet simulate the look of traditional solid wood instruments.

While each of the foregoing hollow body stringed instrument construction techniques illustrated in FIGS. 4 and 5 are viable alternatives to the traditional solid wood construction techniques, both have drawbacks associated therewith in terms of instrument performance. It is generally understood that transverse grain and non-uniform wood species laminations tend to dampen the response of a stringed instrument, and hollow body stringed instruments produced thereby are accordingly less preferred by musicians striving for excellence in tonal response.

Other hollow body stringed instrument manufacturers have sought to develop instrument construction techniques that avoid such drawbacks yet still provide alternatives to the traditional solid wood structures. For example, traditional solid wood backs and sides for steel string acoustic guitars have been replaced on some models with polymer-based bowls or domes of uniform construction in an effort to controllably direct sound from inside the instrument back to the instrument soundboard and/or to reduce material costs. As another example, steel string acoustic guitars have recently been constructed, in whole and in part, from graphite/resin compositions in an effort to provide rugged and robust instruments that attempt to replicate the tonal response of traditional solid wood instruments. However, regardless of the efficacy of such alternative construction techniques, there remains a great demand among musicians and stringed instrument collectors ranging from the most discriminating to the inexperienced novice for hollow body stringed instruments constructed of solid wood components.

Although hollow body stringed instruments constructed of solid wood components have employed a variety of different hard wood species as the back and side body components as described briefly hereinabove, two particular wood types have traditionally been used universally by individual luthiers and large-scale instrument manufacturers alike; namely mahogany and rosewood. It is generally understood that a hollow body stringed instrument constructed with a mahogany back and sides produces "brighter" tones more tightly focused in the mid-range frequencies while those constructed with rosewood back and sides produce "darker" tones with comparatively better bass frequency response. Hollow body stringed instruments of both wood types are highly sought after by musicians and novices alike, and many instruments of both types have been, and continue to be, constructed. However, while mahogany continues to be sufficiently abundant, one particularly desirable species of rosewood is in short supply.

Beginning approximately in the late 1800's, flat top acoustic guitars produced in the United States having rosewood backs and sides were typically constructed from Dalbergia Nigra, commonly known as Brazilian rosewood. This species was generally preferred by luthiers over other rosewood species in part because of its superior hardness, strength, tonal properties and aesthetic appearance, but also because of its abundance, ready availability and close proximity to U.S. guitar manufacturers. This trend continued into the $20^{th}$ century, and flat top acoustic guitar production began to increase dramatically after World War II.

Around 1969, the Brazilian government placed certain restrictions on the exportation of Brazilian rosewood, requiring it to be at least partially milled within Brazil. This dramatically increased the cost of Brazilian rosewood to consumers outside of Brazil, and U.S. acoustic guitar manufacturers generally responded to this embargo by seeking out other species of rosewood for guitar fabrication. Consequently, most acoustic guitars built by major U.S. acoustic guitar manufacturers and others after 1969 with rosewood backs and sides were constructed with Indian rosewood, which was cheaper to import than Brazilian rosewood and is believed by many to be tonally similar to Brazilian rosewood, but which is somewhat less hard and far less aesthetically attractive.

In 1992, the Convention on International Trade in Endangered Species (CITES) added Dalbergia Nigra; i.e., Brazilian rosewood, to its list under Appendix I which prohibits international commercial trade in logs, veneer, lumber, finished products and other derivatives wood species that is threatened with extinction and that are or may be affected by trade. One important exemption to the trade restrictions imposed by CITES is wood that was harvested prior inclusion of the species in Appendix I. Thus, CITES allows importation and exportation of Brazilian rosewood products if certified by the Department of the Interior that any such products are made from Brazilian rosewood that was exported from Brazil prior to inclusion in Appendix I; i.e., before March of 1992.

Although most rosewood used for acoustic guitar construction between 1970 and 1992 was of the Indian rosewood species due to the cost and/or availability of Brazilian rosewood, many guitar makers and other luthiers maintained their stockpiles of Brazilian rosewood for limited edition instrument manufacture. In addition to maintaining existing stockpiles, some lumber retailers, furniture manufacturers and the like also continued to purchase additional Brazilian rosewood for specialty projects until CITES added this species to Appendix I in June of 1992.

As a result of the 1992 CITES regulations, there exists today in the U.S. only a limited supply of Brazilian rosewood having sufficient thickness from which to construct acoustic guitar body components such as backs and sides. It is accordingly understood that unless Appendix I is amended, such a supply will soon be depleted.

It is also generally known and understood that many of the wood varieties typically used by luthiers in the construction of stringed instruments are cheaper to purchase in veneer form than in thicknesses (e.g., 0.08–0.125 inches) suitable for solid wood instrument manufacture. What is therefore needed is an improved technique for generally fabricating hollow body stringed instrument body components, such as backs, sides and/or tops, from veneer stock. Such a technique would not only reduce the cost of wood used for at least some of the body components of such instruments, but would further make efficient use of existing supplies of pre-CITES Brazilian rosewood in order to maximize the availability of such wood for future acoustic guitar construction.

SUMMARY OF THE INVENTION

The present invention comprises one or more of the following features or combinations thereof. A body component for a hollow body stringed instrument formed of a number of veneers all of a common wood species, wherein the number of veneers are arranged in juxtaposition such that the grain pattern of each veneer lies along a common orientation. The opposing faces of adjacent ones of the plurality of veneers are bonded together to form a composite veneer stack, and the composite veneer stack forms a body component for the hollow body stringed instrument. Any number of veneers may be used, and the veneers may be flitch-matched to thereby provide a composite laminate structure that closely resembles a solid wood sheet. Alternatively, the one or more of the veneers may be formed of a lower grade wood whereas the outside veneers are formed of a higher grade wood. What results is a composite laminate structure of common wood type and with common grain orientation, but wherein one or more of the interior veneers are formed of a lower grade, and accordingly cheaper, wood than that of the outside two veneers.

One object of the present invention is to provide hollow body stringed instrument fabrication techniques for providing simulated solid wood body components using wood veneers.

Another object of the present invention is to provide hollow body stringed instrument body components using such techniques.

These and other objects of the present invention will become more apparent from the following description of the illustrative embodiments.

DESCRIPTION OF THE ILLUSTRATIVE EMBODIMENTS

Figure 1:
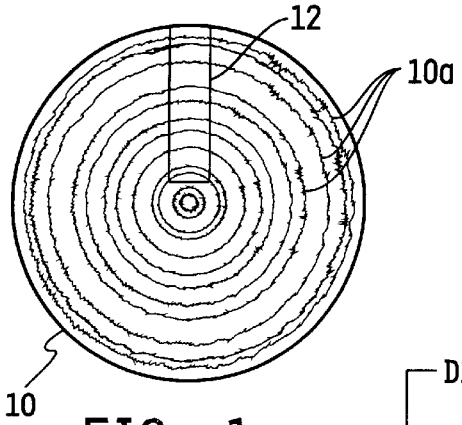
FIG. 1 (PRIOR ART)
FIG. 1 is an end view of a log harvested from a tree illustrating a known technique for producing quarter-sawn lumber.
Figure 2:
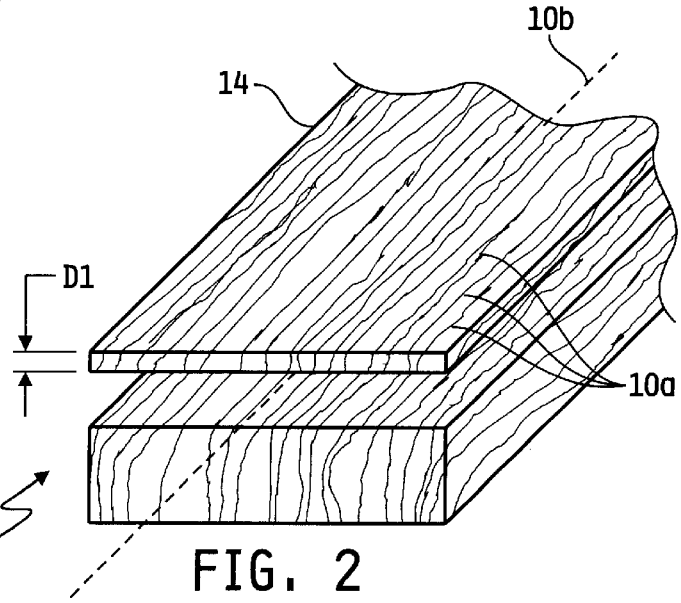
FIG. 2 (PRIOR ART)
FIG. 2 is a perspective view of a quarter-sawn sheet of wood illustrating slicing therefrom in a known manner of a thickness suitable for use as a body component for a hollow body stringed instrument.
Figure 3:
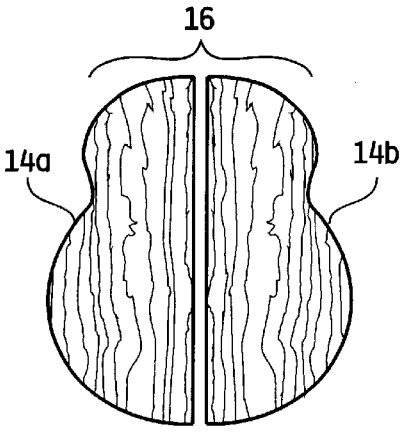
FIG. 3 (PRIOR ART)
FIG. 3 is a top plan view of two book-matched sheets of quarter-sawn lumber prepared in a known manner for use in fabricating a body component for a hollow body stringed instrument.
Figure 4:
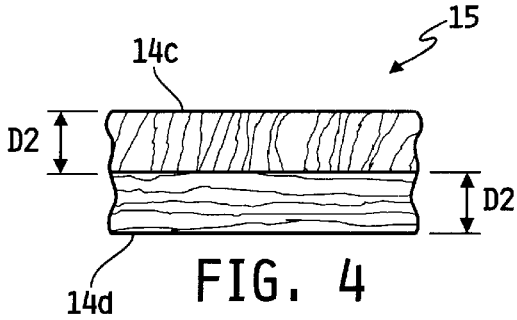
FIG. 4 (PRIOR ART)
FIG. 4 is a cross-sectional view of one known technique for constructing a body component for a hollow body stringed instrument as a laminated wood structure.
Figure 5:
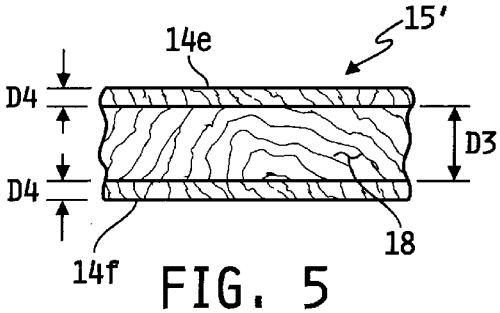
FIG. 5 (PRIOR ART)
FIG. 5 is a cross-sectional view of another known technique for constructing a body component for a hollow body stringed instrument as a laminated wood structure.

For the purposes of promoting an understanding of the principles of the invention, reference will now be made to a number of preferred embodiments illustrated in the drawings and specific language will be used to describe the same. It will nevertheless be understood that no limitation of the scope of the invention is thereby intended.

Many hardwoods that are commonly understood to be desirable for hollow body stringed instrument construction have traditionally been desirable for myriad other applications as well. For example, Brazilian rosewood, certain types of Mahogany, Koa, Ebony and other hardwoods often used in the construction of hollow body stringed instruments have likewise been popular in the piano, furniture, cabinet and paneling industries as well as among wood sculptors, billiard table manufacturers, gun and knife makers, and others. However, the traditionally high cost of such wood has typically led at least some of these industries to request much of their stock of this wood in the form of thin veneer strips and/or sheets. Many of the products manufactured in such industries from these veneer strips or sheets are accordingly laminated structures having at least one such veneer strip or sheet face-bonded to a core material that is of a different material or wood species than that of the veneer strip or sheet.

Figure 6:
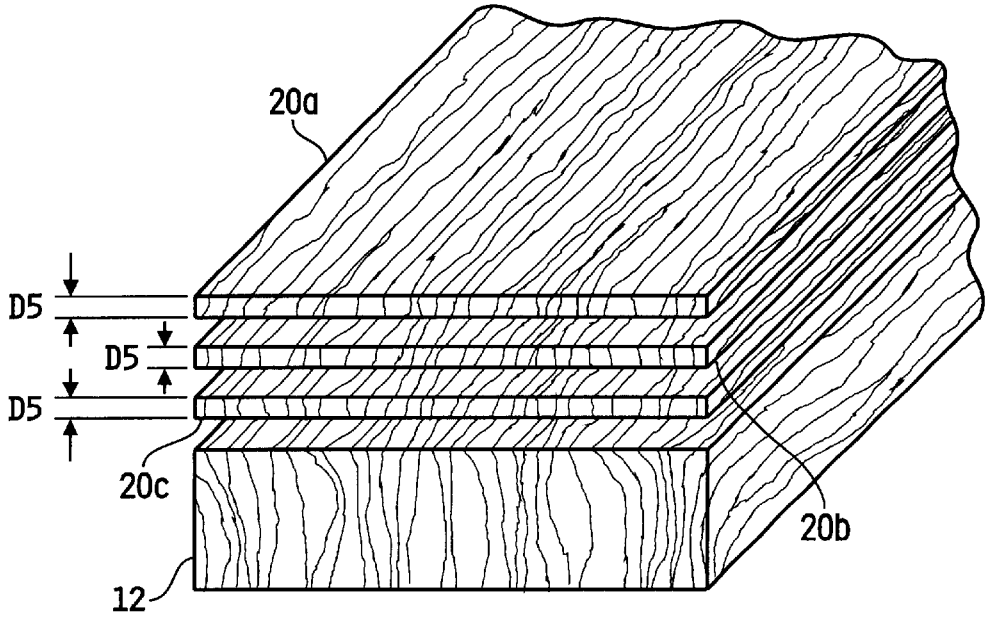
FIG. 6 (PRIOR ART)
FIG. 6 is a perspective, exploded view of a quarter-sawn sheet of wood illustrating slicing therefrom in a known manner of a number of veneer flitches.

Providing hardwoods in the form of thin veneers tends to maximize profits in the sale of such wood, and hardwood suppliers have therefore traditionally met the demand for thin hardwood veneers with enthusiasm by providing an abundant supply of such wood. Veneer strips or sheets are typically prepared by consecutively slicing thin strips or sheets from a wood plank in a known manner as shown by example in FIG. 6. Referring to FIG. 6, a stock of quarter-sawn lumber 12 is shown having a number of veneers 20*a*, 20*b* and 20*c* each of thickness D5 sliced therefrom, wherein thickness D5 may typically range between 0.02–0.035 inches. The veneers 20*a*–20*c* are each commonly referred to as a "flitch", and suppliers of hardwood veneers typically provide hardwood veneers as bundles of flitches, indicating that the veneers contained therein were consecutively sliced from the stock lumber.

For at least the reasons just described, industries and individuals requiring Brazilian rosewood had access to an abundance of Brazilian rosewood veneers prior to the 1992 CITES regulations. Although most hollow body stringed instrument manufacturers and independent luthiers have heretofore typically regarded such veneers to be too thin for use in the construction of hollow body stringed instruments, and have therefore generally not sought to obtain significant quantities thereof, other hardwood processing industries such as those described hereinabove have, prior to the 1992 CITES regulations, purchased significant quantities of Brazilian rosewood veneers, typically in bundles of flitches. As a result, while hollow body stringed instrument manufacturers and independent luthiers may have only a limited supply of Brazilian rosewood of sufficient thickness to construct solid wood hollow body stringed instruments, significant quantities of Brazilian rosewood, as well as other wood desirable for use in stringed instrument fabrication, exists within the U.S. in the form of thin veneer strips and/or sheets that is generally believed to be too thin for use in the construction of such instruments.

Simulated solid wood body components for hollow body stringed instruments may be fabricated by face-joining a number of sheets of quarter-sawn, common species, wood veneers. In one embodiment, the wood veneers are provided as hardwood veneers suitable for fabricating backs, sides, necks, fingerboards, bridges, and/or necks (and sometimes tops) of some hollow body stringed instruments. In one illustrative embodiment, the hardwood veneers used for such instrument fabrication may be Brazilian rosewood veneers, although those skilled in the art will recognize that the hardwood veneers may alternatively be any wood species from which it is desirable to fabricate such body components for hollow body stringed instruments. Examples of such alternate hardwood species include, but are not limited to rosewood species other than Brazilian, Mahogany, Maple, Koa, Ebony, Ash, certain species of Cedar, Cypress, Walnut, and the like. In an alternative embodiment, the wood veneers may be provided as softwood veneers suitable for fabricating tops (i.e., soundboards) of some hollow body stringed instruments, wherein examples of such softwood include, but are not limited to, Spruce, certain species of Cedar, Redwood, and the like.

Figure 7:
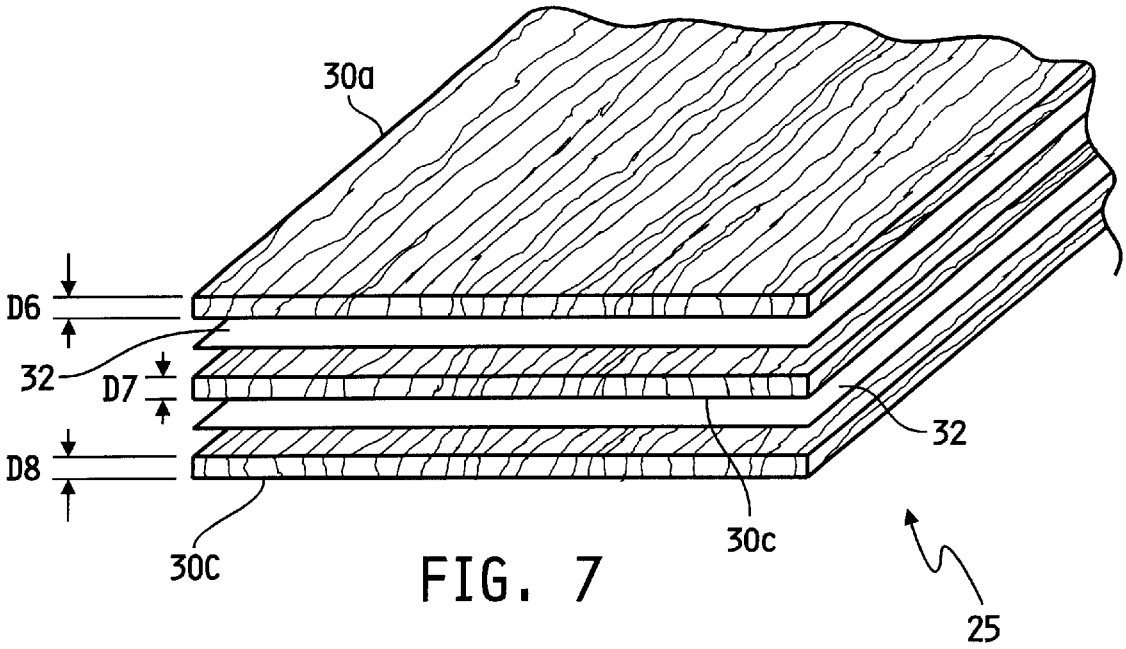
FIG. 7 is a perspective, exploded view of a general composite veneer structure for use in forming a body component for a hollow body stringed instrument.

Referring now to FIG. 7, an exploded view of one illustrative embodiment of a general composite veneer structure 25 for use in forming a body component for a hollow body stringed instrument is shown. Composite veneer structure 25 includes any number of wood veneer sheets arranged in juxtaposed, face-to-face relationship each with commonly oriented grain patterns. In other words, the various quarter-sawn veneer sheets are each arranged within the composite veneer structure 25 with their generally vertical grain patterns running along a common direction. While structure 25 may include any number of veneer sheets, three such veneer sheets 30*a*, 30*b* and 30*c* are shown in FIG. 7 for purposes of illustration. Sheet 30*a* has thickness D6, sheet 30*b* has thickness D7 and sheet 30*c* has thickness D8, wherein D6, D7 and D8 may or may not be similar as will be described in greater detail hereinafter with respect to FIGS. 8A–8C.

A formable medium is disposed between each pair of veneer sheets for bonding the various veneer sheets together. As shown by example in FIG. 7, formable medium 32 is disposed between each pair of veneer sheets 30*a*/30*b* and 30*b*/30*c*. In one illustrative embodiment, the formable medium 32 is a known epoxy that is curable under normal room temperature conditions to form a permanent bond between the various veneer sheets. In this embodiment, the epoxy medium beneficially provides a vapor barrier between the various veneer sheets that serves to minimize the likelihood that the resulting composite structure 25 will form one or more cracks due to exposure to extreme and/or rapidly changing environmental conditions such as temperature and humidity. It is to be understood, however, that other known bonding mediums may alternatively be used as the formable medium 32, and that any such alternate bonding mediums are intended to fall within the scope of the present invention. Examples of such alternative bonding mediums include, but are not limited to, organic adhesives, synthetic adhesives, formable resins, and the like. In any case, it is desirable for the formable medium to be acoustically transmissive so as not to adversely affect the tonal quality of the resultant composite structure 25. Moreover, it is desirable that the amount of formable medium 32 applied between each of the veneer sheets should be only enough to form a suitable bond between the two sheets without adding unnecessary thickness to the overall composite structure 25. With the arrangement of the general composite structure 25 as just described, the tonal qualities of the wood species forming the structure 25 should be preserved, thereby providing a veneer-based structure of appropriate thickness that closely simulates a solid wood structure both in appearance and in tonal quality.

Figure 8A:
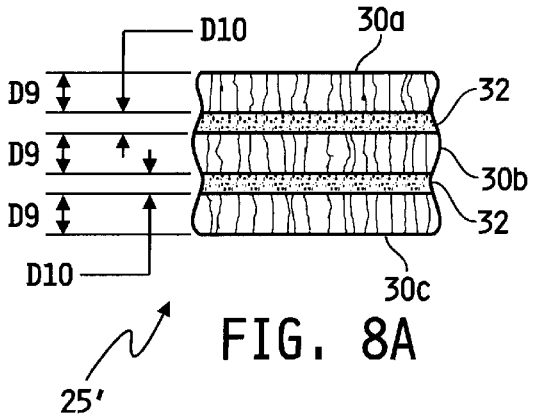
FIG. 8A is a cross-sectional view of one illustrative embodiment of the general composite veneer structure illustrated in FIG. 7.

Referring now to FIG. 8A, one illustrative embodiment 25' of the general composite veneer structure 25 of FIG. 7 is shown. In embodiment 25', veneer sheets 30*a*, 30*b* and 30*c* represent veneer flitches such that the composite veneer structure 25' forms a flitch-matched composite structure. By flitch-matching the various veneer sheets, the aesthetic appearance of the structure 25' will not be adversely altered if, for example, during later fabrication processes one or more of the veneer sheets is sanded through. In this embodiment, it is desirable for the veneer flitches to be high quality or high-grade flitches so that the resulting stringed instrument body component formed from composite structure 25' closely simulates or replicates a high-quality or high-grade solid wood component. In the embodiment shown, the composite veneer structure 25' is illustrated as being formed with three veneer sheets 30*a*, 30*b*, and 30*c* each having substantially the same thickness D9. A typical range for D9 may be between 0.010–0.030 inches, although other thicknesses are contemplated. It should be understood, however, that any number of thin veneer sheets may be used to form the composite structure 25', wherein the various veneer sheets may have dissimilar thicknesses. The formable medium 32 between sheets 30*a* and 30*b* and between sheets 30*b* and 30*c* defines a thickness D10, wherein D10 generally follows the guidelines for formable medium thickness set forth hereinabove with respect to FIG. 7. In any case, the thickness of each veneer flitch, along with the thickness D9 of the various formable medium layers 32, will dictate the number of veneer flitches to use in achieving a desired thickness of the resulting composite veneer structure 25'. As one numerical example, 3–4 veneer flitches having thicknesses of approximately 0.020–0.025 will generally be sufficient to form a composite veneer structure 25' suitable for use in forming a back or side portion of a hollow body stringed instrument such as a steel string acoustic guitar.

Figure 8B:
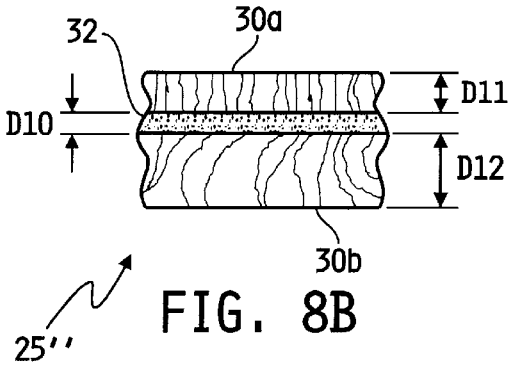
FIG. 8B is a cross-sectional view of an alternate embodiment of the general composite veneer structure illustrated in FIG. 7.

Referring now to FIG. 8B, an alternate embodiment 25" of the general composite veneer structure 25 of FIG. 7 is shown. In embodiment 25", veneer sheet 30*a* represents a high quality or high grade veneer having thickness D11, veneer sheet 30*b* represents a lower quality or lower grade veneer having thickness D12 and veneer sheet 30*c* is omitted. In this embodiment, material cost savings is realized by utilizing a higher-grade wood veneer 30*a* as the surface that will be exposed on a finished product (e.g., outside surface of a back, top or side of a hollow body stringed instrument), and utilizing a cheaper, lower-grade wood veneer 30*b* as the surface that will generally not be exposed on a finished product (e.g., inside surface of a back, top or side of a hollow body stringed instrument). Because the quality of veneer 30*b* is lower than that of veneer 30*a*, it will typically be undesirable to allow any portion of the surface of veneer 30*b* to be exposed through veneer 30*a*. D11 must therefore define a sufficient thickness such that any sanding, scraping or other wood removal process performed on veneer 30*a* subsequent to the formation of the composite veneer structure 25" will not expose veneer 30*b* therethrough. Alternatively, veneer 30*a* may comprise two or more high-quality thinner veneer sheets that are face-bonded as shown in FIG. 8A. In either case, D12 then defines a thickness sufficient to provide the resulting composite veneer structure 25" with a desired overall thickness. As with veneer 30*a*, however, it is to be understood that veneer 30*b* may alternatively comprise any number of thinner, lower quality veneer sheets face-bonded together.

Figure 8C:
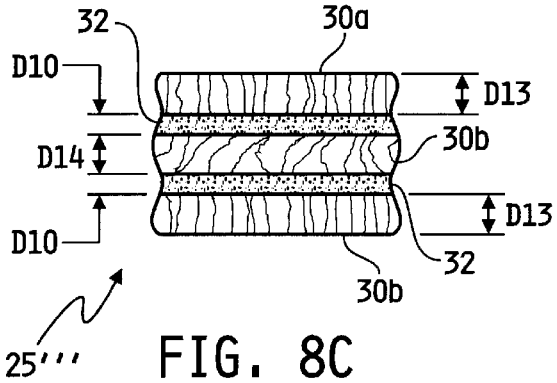
FIG. 8C is a cross-sectional view of another alternative embodiment of the general composite veneer structure illustrated in FIG. 7.

Referring now to FIG. 8C, another alternate embodiment 25'" of the general composite veneer structure 25 of FIG. 7 is shown. In embodiment 25'", veneer sheets 30*a* and 30*b* are identical to veneer sheets 30*a* and 30*b* just described with respect to FIG. 8B; that is veneer sheet 30*a* is a higher quality or higher grade veneer and veneer sheet 30*b* is a lower quality or lower grade veneer. Additionally, composite veneer structure 25'" includes a second higher quality or higher grade veneer layer 30*c* bonded to the opposite face of veneer 30*b* such that the lower quality or lower grade veneer layer 30*b* is sandwiched between high quality veneer layers 30*a* and 30*c*. The higher quality veneer layers 30*a* and 30*c* may or may not be flitch-matched. In any case, the composite veneer structure 25'" is identical in appearance and tonal quality to that of veneer structure 25', yet it provides a material cost savings as compared to veneer structure 25'. As with composite veneer structure 25'" (FIG. 8B), it should be understood that any of the veneers 30*a*, 30*b* and/or 30*c* may alternatively comprise any number of thinner, same-quality veneer sheets face-bonded together.

In the formation of any of the foregoing composite veneer structures 25, 25', 25", and 25'", the resulting composite structure will be inherently flexible until the formable medium 32 cures due to the flexibility of the various veneers forming the composite structure. This property is advantageous in forming a body component for a hollow body stringed instrument since it facilitates and simplifies molding of the composite veneer structure into a desired shape. Once the formable medium cures, the resulting composite veneer structure will rigidly maintain its molded shape. Because the formable medium bonds each veneer together, and because the grain pattern of each veneer is oriented along a common direction, the resulting cured composite veneer structure will generally have significantly less stress than a solid wood component that has been worked into the same shape. Hollow body stringed instrument body components fabricated in accordance with the present invention may thus be more lightly braced, and will therefore be much less prone to deformation and cracking, than their solid wood counterparts.

Figure 9:
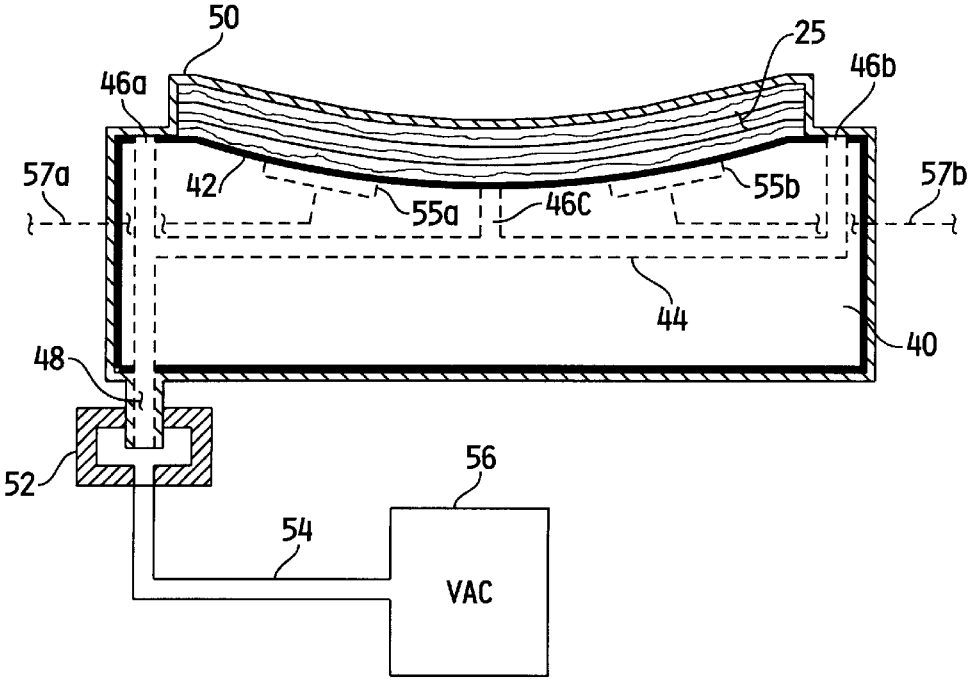
FIG. 9 is a partial cross-sectional view of one illustrative embodiment of a molding process for forming one body component for a hollow body stringed instrument using the general composite veneer structure of FIG. 7.
Figure 10:
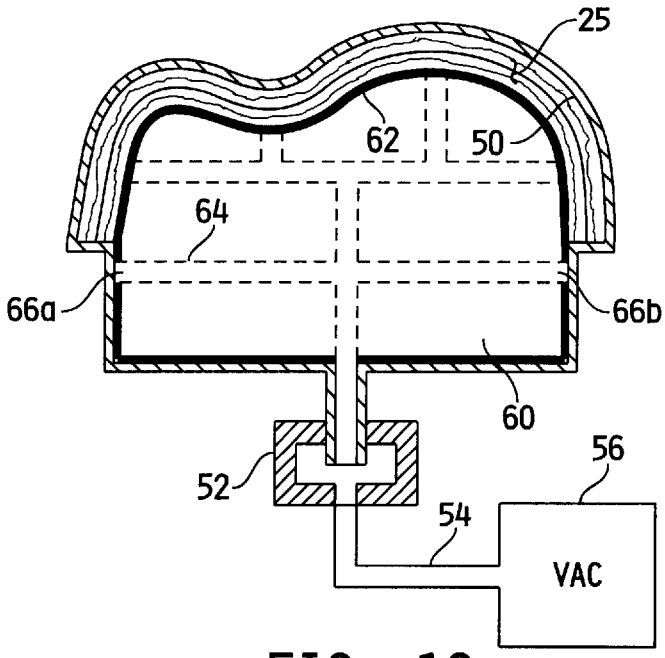
FIG. 10 is a partial cross-sectional view of the molding process shown in FIG. 9 illustrating formation of another body component for a hollow body stringed instrument using the general composite veneer structure of FIG. 7.

Any of a number of known techniques may be used to mold any of the composite veneer structures described herein to a desired shape. For example, if the desired shape of the composite veneer structure is flat, weights and/or clamps may be used in a known manner to hold the composite veneer structure to a flat surface while the formable medium cures. Likewise, if the desired shape is other than flat, a suitable mold may be constructed and weights and/or clamps used in a known manner to force the composite veneer structure into the shape of the mold while the formable medium 32 cures. Alternatively, a mold may be constructed and a known vacuum technology used to force the composite veneer structure into the shape of the mold and maintain it there until the formable medium cures. This latter vacuum molding technique is illustrated in FIGS. 9 and 10 for two different body components of a hollow body stringed instrument. Referring to FIG. 9, a mold 40 defines a recessed portion 42 suitable for forming an arch in a top or back of a hollow body stringed instrument. The mold 40 defines an air passageway 44 therein having openings 46*a*, 46*b* and 46*c* in the top surface thereof, and having an air conduit 48 extending from a bottom surface thereof. Those skilled in the art will recognize that the construction of passageway 44, openings 46*a*, 46*b* and 46*c* and conduit 48 are provided only by way of illustration, and that other constructions therefore may be used without detracting from the scope of the present invention. In any case, a composite veneer structure 25 (representative of any one or combination of the various composite veneer structures disclosed herein) is placed onto the mold 40, and an air-impervious bag 50 is fitted over the entire mold 40 with an opening disposed about conduit 48. A suitable clamp 52 is fitted over the bag 50 and conduit 48 combination, wherein the clamp 52 has a conduit 54 extending therefrom to a vacuum source 56 of known construction. Mold 40 may include one or more heating elements positioned adjacent to the top surface of mold 40 and electrically connected to a suitable energy source. For example, as illustrated in phantom in FIG. 9, mold 40 may include heating elements 55*a* and 55*b* disposed adjacent to the top surface of mold 40 and electrically connectable to a source of electrical power via signal paths 57*a* and 57*b* respectively. Such heating sources may be included to facilitate curing of the composite veneer structure 25, and/or to help maintain the veneer structure 25 in the desired configuration during the curing process. Alternatively or additionally, the vacuum source 56 may be a bidirectional airflow source operable to directed heated air into the bag 50 before establishing a vacuum therein.

Referring to FIG. 10, another mold 60 defines a curved portion 62 suitable for forming a side of a hollow body stringed instrument. Like mold 40, mold 60 defines an air passageway 64 therein having a number of openings (e.g., openings 66*a* and 66*b*) in an outer surface thereof, and an air conduit 68 extending from a bottom surface thereof. A composite veneer structure 25 is placed onto the mold 60, and an air-impervious bag is fitted over the entire mold 60 with an opening disposed about conduit 68. A clamp 52 is fitted over the bag 50 and conduit 68 combination, wherein the clamp has a conduit 54 extending therefrom to a vacuum source 56. Although not specifically illustrated in FIG. 10, mold 60 may additionally include one or more heating elements positioned adjacent to the outer surface thereof, as described with respect to FIG. 9. Additionally or alternatively, the vacuum source 56 may be a bi-directional airflow source operable to directed heated air into the bag 50 before establishing a vacuum therein.

In the operation of either of the molding arrangements illustrated in FIGS. 9 and 10, vacuum is applied through passageway 44 or 64, removing air within bag 50. As vacuum is continually applied, the bag 50 forces the composite veneer structure 25 into the shape of the mold 40 or 60, where it is maintained until the formable medium cures. In each case, the composite veneer structure is identified generally as 25, although it should be understood that the composite veneer structure may be any of the veneer structures 25', 25" or 25'" shown and described with respect to FIGS. 8A–8C.

Figure 11:
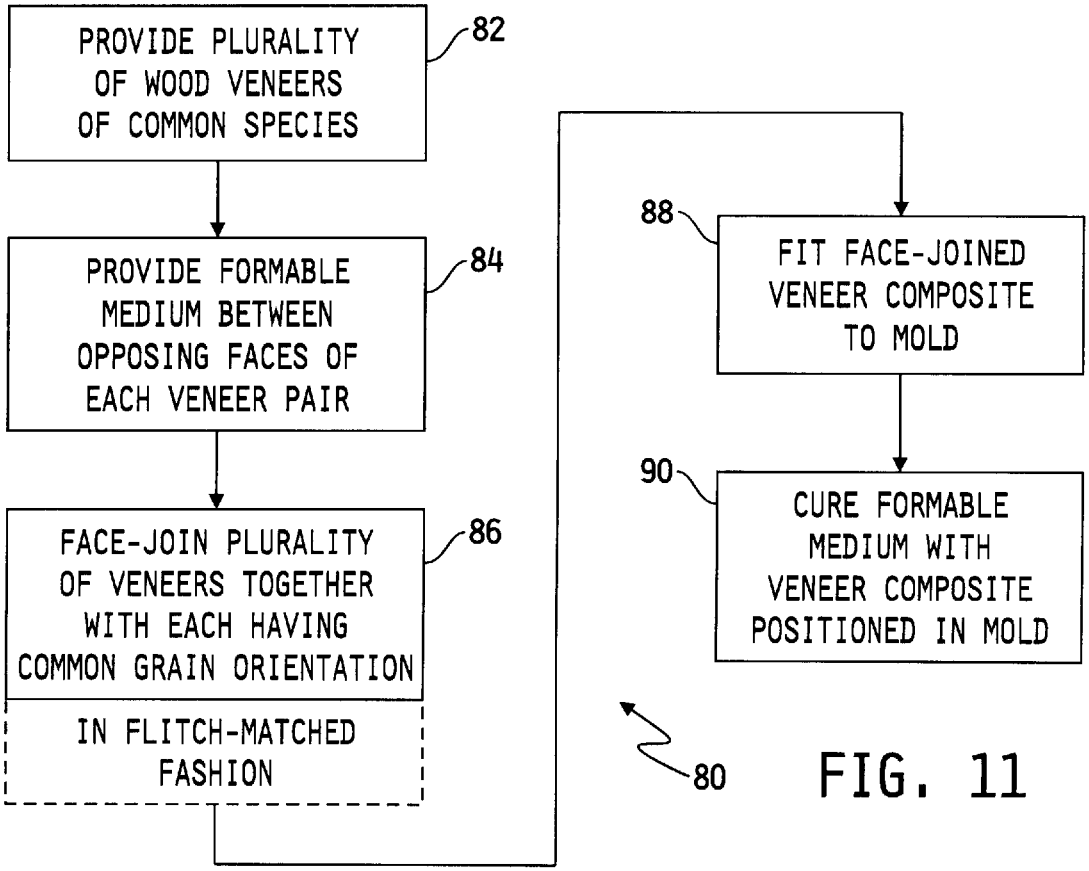
FIG. 11 is a process flow diagram illustrating one illustrative process for forming a body component for a hollow body stringed instrument as shown in FIGS. 7–10.

Referring now to FIG. 11, a process flow diagram is shown illustrating one embodiment of a process flow 80 for fabricating a body component for a hollow body stringed instrument. Process 80 begins at step 82 where a plurality of wood veneers, all of a common wood species, are provided. The actual number of wood veneers used will be dictated by the particular application of the present invention, as described hereinabove. Following step 82, process 80 advances to step 84 where a formable medium is provided between opposing faces of each veneer pair as illustrated in FIGS. 7–8C in accordance with any known technique therefore. In one embodiment, the formable medium is applied to the face of only one veneer, although the present invention contemplates applying the formable medium to both of the opposing faces of each veneer pair. In any case, it is desirable to apply the formable medium in such a manner that it results in a complete and permanent bond between the two veneer faces.

Following step 84, process 80 advances to step 86 where the plurality of veneers are face-joined together with each of their grain patterns lying along a common orientation. Optionally, as in some case wherein two or more adjacent veneers are high-quality or high-grade veneers, step 86 may include flitch matching such adjacent veneers. Thereafter at step 88, the composite veneer structure is fitted to a suitable mold using any one or more of the molding techniques described herein. Following step 88, process 80 advances to step 90 where the composite veneer structure is maintained in the mold until the formable medium cures.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected. For example, while the concepts and techniques described herein were disclosed in the context of fabrication of body components for hollow body stringed instruments, those skilled in the art will recognize that such techniques may be applied directly in the fabrication of other stringed instrument components. Examples of such other stringed instrument components include, but are not limited to, fingerboards, necks, head stocks, bridges, bridge plates, braces, kerfing, neck blocks, tail blocks, and the like.

What is claimed is:

1. A body component for a hollow body stringed instrument comprising a plurality of veneers all of a common wood species and each defining a grain pattern, said plurality of veneers juxtaposed in face-to-face relationship with each of said grain patterns defining a common orientation and with opposing faces of adjacent ones of said plurality of veneers bonded together to form a composite veneer stack, said composite veneer stack forming a body component for a hollow body stringed instrument.

2. The body component of claim 1 wherein said body component forms a back of said hollow body stringed instrument.

3. The body component of claim 1 wherein said body component forms a side of said hollow body stringed instrument.

4. The body component of claim 1 wherein said body component forms a soundboard of said hollow body stringed instrument.

5. The body component of claim 1 wherein said plurality of veneers each define a common thickness.

6. The body component of claim 5 wherein each of said plurality of veneers defines a flitch.

7. The body component of claim 6 wherein adjacent ones of said plurality of veneers forming said composite veneer stack are flitch-matched such that said composite veneer stack thereby simulates a solid wood structure.

8. The body component of claim 1 wherein one outer veneer forming said composite veneer stack defines a first quality veneer;

wherein a remainder of said composite veneer stack comprises a single second lower quality veneer than said first quality veneer, said one outer veneer forming an external face of said body component.

9. The body component of claim 8 wherein said one outer veneer defines a first thickness;

and wherein said single second quality veneer defines a second thickness greater than said first thickness.

10. The body component of claim 1 wherein outer veneers forming said composite veneer stack each define first quality veneers;

and wherein a remainder of said composite veneer stack comprises a single inner veneer defining a second lower quality veneer than said first quality veneer.

11. The body component of claim 10 wherein said outer veneers each define a first thickness;

and wherein said single inner veneer defines a second thickness greater than said first thickness.

12. The body component of claim 1 further including a formable medium disposed between said opposing faces of said adjacent ones of said plurality of veneers, said formable medium curing to bond said opposing faces of said adjacent ones of said plurality of veneers together.

13. The body component of claim 12 wherein said body component is flexibly molded to a predefined shape prior to curing said formable medium, said body component rigidly maintaining said predefined shape after curing said formable medium.

14. The body component of claim 1 wherein said common wood species is Brazilian rosewood.

15. A method of forming a body component for a hollow body stringed instrument, the method comprising the steps of:

providing a plurality of veneers all of a common wood species and each defining a grain pattern;

applying a formable medium to at least one of a first face defined by one of said plurality of veneers and a second face defined by another one of said plurality of veneers;

arranging said first face in juxtaposition with said second face with said grain patterns of each of said veneers defining a common orientation;

bringing said first face into contact with said second face;

sequentially performing said applying, arranging and bringing steps with remaining ones of said plurality of wood veneers to form a veneer stack composed of said plurality of veneers; and curing said formable medium to form a composite veneer stack, said composite veneer stack forming a body component for a hollow body stringed instrument.

16. The method of claim 15 further including the step of molding said veneer stack to a predefined shape prior to said curing step;

and wherein said composite stack resulting from said curing step rigidly retains said predefined shape.

17. The method of claim 15 wherein each of said plurality of veneers defines a flitch;

and further including the step of flitch-matching said one of said plurality of veneers with said another one of said plurality of veneers prior to said applying step, said composite veneer stack thereby defining a flitch-matched veneer stack simulating a solid wood structure.

18. The method of claim 15 one outer veneer forming said composite veneer stack defines a first quality veneer;

and wherein a remainder of said composite veneer stack comprises a single second lower quality veneer than said first quality veneer, said one outer veneer forming an external face of said body component.

19. The method of claim 15 wherein outer veneers forming said composite veneer stack each define first quality veneers;

and wherein a remainder of said composite veneer stack comprises a single inner veneer defining a second lower quality veneer than said first quality veneer.

20. The method of claim 15 wherein said common wood species is Brazilian rosewood.

* * * * *